US006524405B1

(12) United States Patent
Lin

(10) Patent No.: US 6,524,405 B1
(45) Date of Patent: Feb. 25, 2003

(54) IRON BASE HIGH TEMPERATURE ALLOY

(76) Inventor: Hui Lin, 48 Pennsylvania Ave., Malvern, PA (US) 19355

( * ) Notice: Subject to any disclaimer, the term of this patent is extended or adjusted under 35 U.S.C. 154(b) by 0 days.

(21) Appl. No.: 09/540,403

(22) Filed: Mar. 31, 2000

Related U.S. Application Data

(60) Provisional application No. 60/181,936, filed on Feb. 11, 2000.

(51) Int. Cl.[7] ..... C22C 28/00; C22C 38/06; C22C 38/18

(52) U.S. Cl. ..... 148/325; 148/326; 148/328; 148/333; 148/419; 148/423; 148/442; 420/62; 420/79; 420/100; 420/583; 420/428

(58) Field of Search ..... 420/62, 79, 100, 420/583, 428; 148/328, 325, 333, 326, 419, 423, 442

(56) References Cited

U.S. PATENT DOCUMENTS

| | | | | | |
|---|---|---|---|---|---|
| 2,043,631 | A | * | 6/1936 | Scheil | 420/79 |
| 3,785,805 | A | | 1/1974 | Van Den Boomgaard | |
| 3,893,849 | A | * | 7/1975 | Brickner | 420/79 |
| 4,235,623 | A | | 11/1980 | Rath | |
| 4,615,732 | A | | 10/1986 | Shastry et al. | |
| 4,769,214 | A | | 9/1988 | Sherby et al. | |
| 4,836,981 | A | * | 6/1989 | Shimada et al. | 420/79 |
| 4,844,865 | A | * | 7/1989 | Shimada et al. | 420/79 |
| 4,859,649 | A | * | 8/1989 | Bohnke et al. | 420/79 |
| 4,961,903 | A | | 10/1990 | McKamey et al. | |
| 5,084,109 | A | * | 1/1992 | Sikka | 148/320 |
| 5,085,829 | A | * | 2/1992 | Ishii et al. | 420/79 |
| 5,286,442 | A | * | 2/1994 | Uematsu et al. | 420/70 |
| 5,346,562 | A | | 9/1994 | Batawi et al. | |
| 6,231,807 | B1 | * | 5/2001 | Berglund | 420/62 |

FOREIGN PATENT DOCUMENTS

| | | | | |
|---|---|---|---|---|
| CN | 19930114921.5 | | 6/1994 | |
| DE | 2339869 | * | 2/1974 | 420/79 |
| DE | 19603515 C1 | | 12/1996 | |

OTHER PUBLICATIONS

English abstract of Russian patent 384924, Vagin et al, 1971.*

Metals Handbook , 1948 edition, published by the American Society for Metals, p. 13.*

ASM Materials Engineering Dictionary, edited by J.R. Davis, 1992, p. 231.*

English abstract of Japanese patent 1031922, Yoshizawa, et al , Hitachi Metals, 1987.*

English abstract of German patent 19603515, Luster et al, 1996.*

(List continued on next page.)

*Primary Examiner*—Deborah Yee
(74) *Attorney, Agent, or Firm*—Finnegan, Henderson, Farabow, Garrett & Dunner, L.L.P.

(57) ABSTRACT

The present invention is directed to an iron, aluminum, chromium, carbon alloy and a method of producing the same, wherein the alloy has good room temperature ductility, excellent high temperature oxidation resistance and ductility. The alloy includes about 10 to 70 at. % iron, about 10 to 45 at. % aluminum, about 1 to 70 at. % chromium and about 0.9 to 15 at. % carbon. The invention is also directed to a material comprising a body-centered-cubic solid solution of this alloy, and a method for strengthening this material by the precipitation of body-centered-cubic particles within the solid solution, wherein the particles have substantially the same lattice parameters as the underlying solid solution. The ease of processing and excellent mechanical properties exhibited by the alloy, especially at high temperatures, allows it to be used in high temperature structural applications, such as a turbocharger component.

39 Claims, 1 Drawing Sheet

• BCC SOLID SOLUTION > 97% FROM X-RAY POWDER DIFFRACTION
× BCC SOLID SOLUTION < 97% FROM X-RAY POWDER DIFFRACTION

OTHER PUBLICATIONS

"Iron Aluminides" by C. G. McKamey, Chapter 9, pp. 351–391. Date?.

R.G. Baligidad, et al., "Processing of High Carbon $Fe_3Al$ based Intermetallic Alloy," *Intermetallics* 6:765–769 (1998).

R.G. Baligidad, et al., "Effect of Alloying Additions on Structure and Mechanical Properties of High Carbon Fe–16 wt.% Al Alloy," *Materials Science & Engineering* A287:17–24 (2000).

* cited by examiner

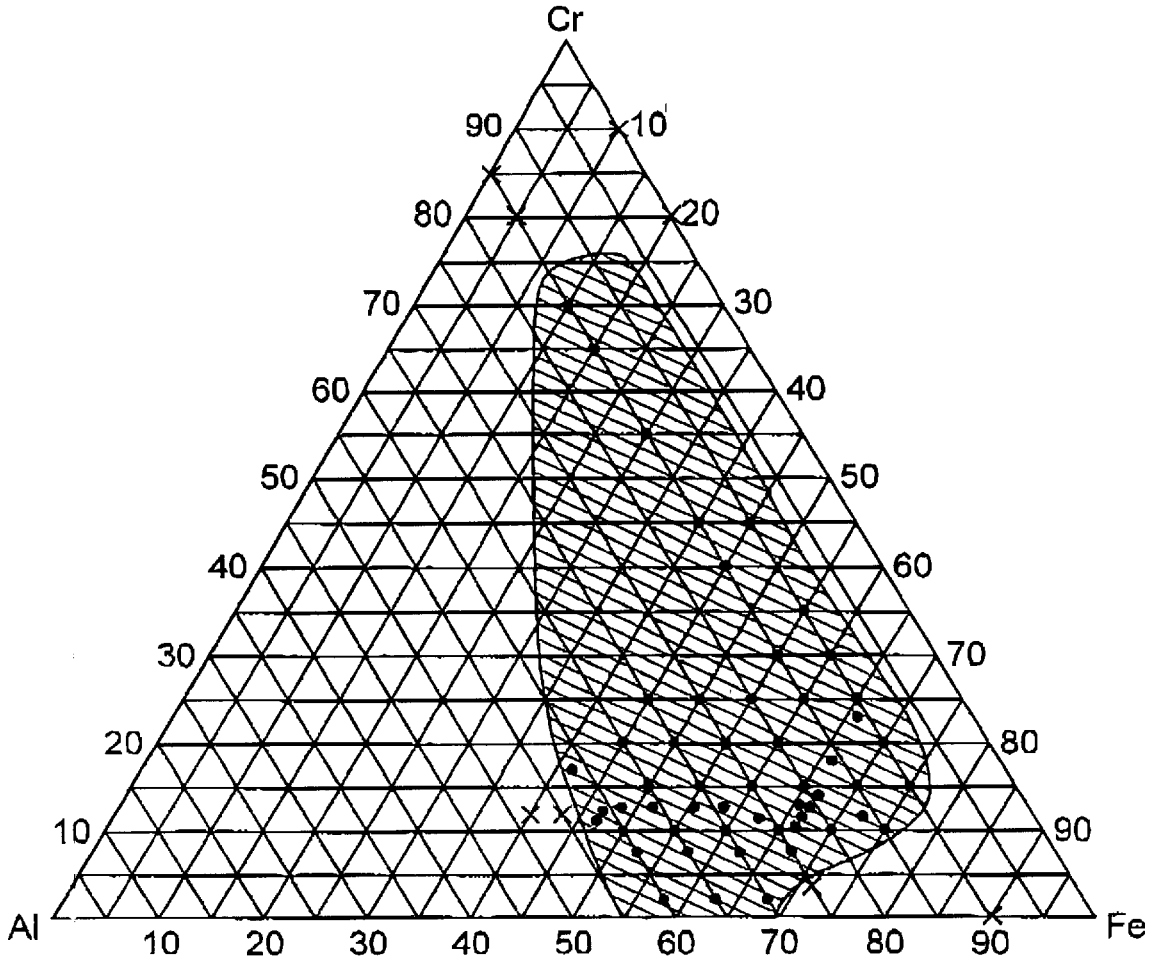
• BCC SOLID SOLUTION > 97% FROM X-RAY POWDER DIFFRACTION
× BCC SOLID SOLUTION < 97% FROM X-RAY POWDER DIFFRACTION

IRON BASE HIGH TEMPERATURE ALLOY

This application claims priority under 35 U.S.C. §120 to U.S. provisional application serial No. 60/181,936, filed Feb. 11, 2000.

The present invention is directed to an iron base, heat and corrosion resistant alloy that has low density, good tensile ductility, and excellent properties related to oxidation resistance, corrosion resistance, castability and strength. This new class of alloys is about 20–25% lighter and 20–80% cheaper than most traditional nickel-containing steels, e.g., stainless steels, heat resistant steels and heat resistant alloys.

Currently, heat resistant structural applications most often employ heat resistant steels, heat resistant alloys and superalloys. There is, however, a need for materials with similar properties having a much lower density since heat-resistant steels, heat-resistant alloys, and superalloys have relatively high densities. While alternative materials such as ceramics and intermetallic ordered alloys are being studied for their low densities, none of them have achieved the combination of low density, adequate tensile ductility, high strengths, and good oxidation resistance that is needed for high temperature engineering applications.

In the case of ceramics, their complete lack of tensile ductility severely limits the advantage of their low densities. In addition, ceramic components are usually produced through a powder sintering process which is a relatively costly process. Because of their lack of ductility and high cost, ceramics parts can only be used in very limited applications.

Light intermetallic ordered materials have not achieved adequate intrinsic tensile ductility and exhibit low fracture toughness, especially at room temperature. As a result of these properties, relatively complex processing techniques have to be employed to produce these materials and fabricate them into components. This significantly increases the production costs and their relatively low toughness at room temperature can cause handling problems and high component rejection rates.

An example of such an intermetallic ordered material is $Fe_3Al$. Unlike pure iron, which is a body centered cubic (BCC) solid solution and is very ductile, $Fe_3Al$ forms an ordered BCC structure (generally defined as $DO_3$ at room temperature and $B_2$ at high temperatures) in which Fe atoms and Al atoms are arranged in a regular fashion. $Fe_3Al$ has a low density and reasonably good oxidation resistance up to about 800° C. because of its high aluminum content. The aluminum in the material will easily form an oxide scale in an oxidizing environment, although the oxide scale is not strong and easily spalls at temperatures above 800° C. Moreover, the raw materials for $Fe_3Al$ are also relatively inexpensive. However, $Fe_3Al$ is very brittle and has a low room temperature tensile ductility, it easily fractures in both intergranular and transgranular fashion.

Although chromium containing $Fe_3Al$ has shown limited improvement in tensile ductility and is relatively lightweight, as evidenced by a density of about 6.5 g/cm$^3$, conventional ordered Fe—Al—Cr compositions suffer from relatively poor high-temperature strengths, corrosion resistance and oxidation resistance.

Consequently, the simultaneous achievement of a more affordable heat resistant structural material that has a low density, good tensile ductility, excellent oxidation resistance and excellent workability, is a continuing objective of this field of endeavor. Specifically, there has been a need for a new iron-base alloy having a low density, high strength, adequate tensile ductility, defined as ≧5% tensile elongation, and excellent oxidation and corrosion resistance. The above-mentioned objectives can be substantially realized by adding carbon to a chromium-containing iron aluminum compound such that a body-centered-cubic iron aluminum chromium carbon alloy is formed.

The immediate application for the present invention includes turbochargers for high speed diesel engines used in boats, trucks and passenger cars. Diesel engines are widely used because of better fuel economy than gasoline engines. To achieve such fuel economy, as well as increase engine efficiency and reduce pollution, turbo-chargers are routinely used in high-speed diesel engines. Most industrial trucks as well as about 10% of passenger cars in the world (up to 20% in Europe and 10% in Japan) are powered by high-speed diesel engines with turbochargers.

A turbocharger for a diesel engine is made up of a compressor and a turbine. From a mechanical performance perspective, the turbine is the most critical part, since it operates at high temperatures, e.g., up to 650° C., and under high centrifugal stress due to high-speed rotation. The environment in which a turbine operates can also be both oxidizing and corrosive.

Currently, turbocharger turbines are cast from an iron-nickel base alloy or a nickel base alloy that is both expensive and heavy. Because of the weight, it takes time for present turbochargers to overcome inertia before the turbine can reach the working speed in which it operates most effectively. As evidenced by the emission of a dark cloud of exhaust on sudden acceleration, the exhaust gas is not properly burned during the time it takes for the turbine to reach its operating speed. To solve the above-mentioned problems associated with Fe-Ni base or Ni base-alloy turbochargers, turbocharger turbines and compressors from the body-centered-cubic iron aluminum chromium carbon alloy have been fabricated of the present invention.

SUMMARY OF THE INVENTION

Accordingly, a subject of the present invention is a material comprising a body-centered-cubic, single-phase, solid solution of iron aluminum, specifically Fe—Al—Cr—C. Preferably the material includes about 10 to 80 at. % iron, about 10 to 45 at. % aluminum, about 1 to 70 at. % chromium and about 0.9 to 15 at. % carbon. The material has excellent properties in polycrystalline form. In addition, the material can be strengthened by well-known methods that include solid solution strengthening, grain size refinement or by the introduction of particles of a strengthening phase. Preferably, the material can be strengthened by precipitating within the solid solution, BCC, solid solution particles that have substantially the same lattice parameters as the underlying solid solution. The inventive material is oxidation resistant at temperatures up to 1150° C., and has excellent mechanical properties at temperatures up to about 650° C.

DESCRIPTION OF THE DRAWING

The following drawing, which form a part of the disclosure of the present invention depict additional aspect of the invention. Of the drawing:

FIG. 1 is a ternary phase diagram showing a BCC phase field.

DETAILED DESCRIPTION OF THE INVENTION

The present invention is embodied in a new Fe—Al—Cr—C body-centered-cubic solid solution alloy which has a low density (e.g., in the range of from 5.5 g/cm$^3$ to 7.5 g/cm$^3$, and preferably 6.1 g/cm$^3$), an adequate room temperature tensile ductility, excellent high temperature strength, oxidation resistance and corrosion resistance.

The inventive alloy preferably comprises about 10 to 80 at. % iron, about 10 to 45 at. % aluminum, about 1 to 70 at. % chromium, and about 0.9 to 15 at. % carbon, wherein the combination of aluminum and chromium is preferably present in an amount of at least 30 at. %.

Depending on the desired final properties, chromium content may change and fall into different preferred ranges. For example, cast materials preferably employ about 5 to 20 at. % chromium, while wrought materials employ lower amounts of chromium, e.g., about 1 to 10 at. %.

In the present invention, powder x-ray diffraction is used to determine the existence of a BCC phase from the relative intensities of the diffraction peaks. In this invention, a BCC phase is either a single BCC phase or a combination of several BCC phases with substantially the same lattice parameters. A BCC phase is defined as a phase containing <3% non-BCC phase. That is, even if a diffraction pattern for a phase shows weak non-BCC peaks, the phase is still considered to be a BCC phase if the relative intensity of the non-BCC peaks are <3% of the intensity of the strongest BCC peak. Such a determination is only necessary to define the boundaries of the ternary phase diagram shown in FIG. 1, since a diffraction pattern within those boundaries shows only BCC peaks.

The inventive material has a yield strength of greater than 320 MPa up to and including a temperature of about 650° C. In addition, that the inventive material's yield strength increases or stays the same with increasing temperature from room temperature to about 600° C. In one embodiment, the yield strength of the material increases sharply with increasing temperature from room temperature to about 600° C., which is contrary to traditional BCC materials. The yield strength for BCC materials generally decreases with increasing temperature.

This material can be further strengthened by (a) the incorporation of an additional solid solution phase to said solid solution, (b) grain size refinement, (c) the introduction of particles of a strengthening phase, or (d) the addition of a strengthening element in the solid solution.

The incorporation of an additional solid solution phase can be carried out by the precipitation of body-centered-cubic particles within the solid solution, wherein the particles have substantially the same lattice parameters as the solid solution.

Strengthening can also be carried out by the addition of refractory oxide particles to the solid solution, such as $Y_2O_3$.

In has been unexpectedly discovered that the addition of significant amounts of carbon and chromium transforms light weight iron-aluminum from an ordered BCC alloy, into a BCC solid solution. In addition, it was found that the solubility of the carbon in the present invention increases with increasing amounts of chromium and decreasing amounts of aluminum.

The light-weight alloy possesses an adequate tensile ductility at room temperature. As illustrated by the properties below, the combination of a low density, an adequate tensile ductility and high-temperature strengths is a significant technological breakthrough for light-weight, heat resistant structural materials.

It has been further discovered that standard processing techniques (e.g., casting) can be used to shape the inventive alloy into desired articles. One object of the present invention, therefore, is to produce, using standard processing techniques, an article or a composite comprising solid solution phases of Fe—Al—Cr—C, wherein the solid solution phases are each body-centered-cubic and single-phase, and their lattice parameters substantially match each other.

Another object of the present invention is to produce a turbocharger part, specifically a turbine rotor or a compressor comprising the inventive alloy.

PROPERTIES

A. Oxidation Resistance

The present invention has excellent oxidation resistance, which is defined as the weight change of the material when exposed to a high temperature, oxidizing environment. In fact, the inventive materials exhibit oxidation resistance that is superior to stainless steels, heat-resistant steels, heat-resistant alloys, and superalloys. In one embodiment, the material exhibits a weight loss rate of 0.2 g/m$^2$ day after more than 100 hours at 1000° C. in air. The excellent oxidation resistance is believed to be due to the large amounts of aluminum and chromium in the material. If needed, the oxidation resistance can be further improved by the addition of rare-earth elements to the material.

B. Strength

An article made according to the present invention exhibits high-temperature strength, e.g., up to 650° C., that is superior to stainless steels, and most heat resistant steels and alloys. Considering the low density associated with the material, the specific strength of the material at temperatures up to 650° C. is even more superior. For example, the present invention in as-cast form has a yield strength of greater than 320 MPa up to 650° C. The strength of this alloy can be further improved with conventional strengthening methods such as grain refinement (e.g., hot-rolling followed by re-crystallization to change the microstructure of the article), solid solution strengthening (e.g., incorporating into the solid solution a strengthening element), and second phase particle strengthening.

Second phase particle strengthening can result from the external addition of refractory oxides, such as $Y_2O_3$. Preferably second phase particle strengthening is done internally, via an in situ technique. By adjusting the Fe—Al—Cr—C composition, internal particles of Fe—Al—Cr—C precipitate within the solid solution. For example, the amount and the distribution of the body-centered-cubic particles within the solid solution can be tailored by adjusting the amount of iron, aluminum, chromium and carbon within the composition. These particles are also BCC, their lattice parameters substantially match the surrounding solid solution, which eliminates stress related to gradients between phases, and provides high temperature stability.

The combination of oxidation resistance and high temperature strength associated with the inventive material allows it to be readily used as load bearing components exposed to an oxidizing environment at temperatures of up to 650° C. The present invention can also be used as non load-bearing parts at temperatures as high as 1200° C.

C. Corrosion Resistance

An article comprising the inventive material also exhibits good corrosion resistance when tested in a nitric acid solution. The material has a corrosion resistance rate of less than 0.01 mm/year weight loss in $HNO_3$ solution ranging from 20% to 65% at room temperature. The material also shows no sign of grain boundary corrosion when exposed to the foregoing conditions.

D. Ductility

The present invention has an adequate tensile ductility at room temperature and good tensile ductility at over 700° C. providing good hot workability. For example, the present invention in as-cast form exhibits tensile ductility of over 5% at room temperature and over 95% at approximately 900° C. Therefore, the inventive material was readily hot-rolled at temperatures above 900° C.

E. Castability

Due to the excellent castability properties associated with the present invention, e.g., a low viscosity when molten, standard metal melting and casting techniques can be used in producing finished articles. Articles can be made using conventional induction melting techniques carried out in a controlled or protective atmosphere, e.g., in an inert gas or under vacuum. The unique ability of the material to form near net shape articles is a combination of the fluidity of the molten alloy and the characteristics of the strengthening phase. Preferably, the material has a eutectic structure. This microstructure coupled with excellent flow properties, allows the molten alloy to conform to the shape of the mold, and results in near net shape articles that do not require additional finishing steps before use.

The microstructure of an article made in accordance with the present invention can be further tailored by adjusting the casting temperature. For example, it has been discovered that a higher casting temperature can result in a finer particle size for the secondary, strengthening phase. For purposes of illustration, a fine microstructure is one where the mean size of the secondary phase precipitates is less than approximately 50 $\mu$m, and preferably about 10–20$\mu$m.

ARTICLE

In one embodiment, investment vacuum casting was used to produce a cast turbocharger turbine rotor with the thinnest blade having a thickness of approximately 0.5 mm. As shown in Example 1 below, the as-cast turbocharger turbine rotor exhibited excellent high temperature strengths up to 650° C. This high temperature strength is similar to cast iron-nickel base heat-resistant alloys currently used in turbochargers. However, due to the low density of the inventive material, the specific strength is approximately 25% higher than current cast iron-nickel base turbochargers. For example, the turbocharger turbine comprising the inventive alloy had a density of about 6.1 g/cm$^3$, compared to cast iron-nickel base alloys, which have a density of about 8.1 g/cm$^3$. Therefore, a turbocharger turbine made in accordance with the present invention is approximately 25% lighter in weight than standard iron-nickel base turbocharger turbine rotors.

The light weight turbine rotor of the turbocharger leads to significant reduction in pollution because it overcomes inertia and reaches operating speeds faster than the heavier iron-nickel base turbochargers currently used. Due to this effect, acceleration time can decrease by at least 25%, leading to a more efficient burn of the exhaust gas during acceleration, when compared to the heavier iron-nickel turbocharger. In fact, the light weight alloy of the present invention, when used to make a turbocharger turbine rotors and compressors would assist diesel engines in meeting transient (accelerating) emission standards, in addition to steady state emission standards.

In addition to the above performance benefits, the material costs of the inventive alloy is substantially cheaper, e.g., at least 50% cheaper, than conventional nickel-iron turbochargers. This price difference is primarily associated with the high amounts of nickel present in standard turbochargers, that are not present in the inventive alloy.

Finally, the present alloy has much better oxidation resistance than iron-nickel alloy or nickel base alloy turbocharger turbine rotor.

Having disclosed the present invention generally, the following example further describes the invention.

EXAMPLES

Example 1

An Fe—Al—Cr—C article comprising a composition within the range defined in FIG. 1 was prepared by a standard melting technique. The composition was melted under a vacuum to form a molten Fe—Al—Cr—C alloy, which was then poured into a mold having a cavity in the shape of the article. The as-poured mold remained under a vacuum until it was sand-cooled in air to room temperature to form the as-cast article. The as-cast article was subsequently removed from the mold, and was found to be a Fe—Al—Cr—C body-centered cubic, solid solution having a density of about 6.1 g/cm$^3$.

The mechanical properties of the as-cast article are shown in Table 1. As can be seen, a material within the present invention exhibits excellent yield and tensile strength up to 650° C., and good ductility, particularly at 900° C.

TABLE 1

Mechanical Properties of a bcc Fe—Al—Cr—C alloy

| Temperature (° C.) | 0.2% Offset Yield Strength $\sigma_y$ (MPa) | Tensile Strength $\sigma_b$ (MPa) | Elongation (%) |
|---|---|---|---|
| Room Temp. | 360 | 500 | 5.3 |
| 200 | 375 | 580 | 5.8 |
| 400 | 364 | 617 | 8.8 |
| 500 | 353 | 600 | 8.7 |
| 600 | 361 | 530 | 8.7 |
| 650 | 324 | 403 | 9.3 |
| 700 | 170 | 247 | 33 |
| 750 | 116 | 168 | 43 |
| 800 | 90 | 112 | 66.7 |
| 900 | 54 | 68 | 95.8 |
| 1000 | 26 | 32 | 39.2 |

Table 2 further shows that the inventive material is almost completely oxidation resistant up to 1150° C.

TABLE 2

Oxidation Resistance Properties of a bcc Fe—Al—Cr—C alloy

| Temperature (° C.) | Weight Change Rate after 100 hours in air (g/m$^2$d) |
|---|---|
| 600 | 0.015 |
| 700 | 0.074 |
| 800 | 0.065 |
| 900 | 0.096 |

TABLE 2-continued

Oxidation Resistance Properties of a bcc Fe—Al—Cr—C alloy

| Temperature (° C.) | Weight Change Rate after 100 hours in air ($g/m^2d$) |
|---|---|
| 1000 | −0.2 |
| 1100 | −2 |
| 1150 | 0.42 |

Table 3 illustrates the excellent corrosion resistance properties, even in a 65% solution of nitric acid, of the inventive material.

Corrosion Resistance Properties of a bcc Fe—Al—Cr—C alloy

| $HNO_3$ solution (%) | Corrosion Rate mm/yr |
|---|---|
| 5 | 0.04 |
| 20 | 0.009 |
| 35 | 0.0084 |
| 50 | 0.0062 |
| 65 | 0.0075 |

The present invention has been disclosed generally and by reference to embodiments thereof. The scope of the invention is not limited to the disclosed embodiments but is defined by the appended claims and their equivalents.

What is claimed is:

1. A material comprising a body-centered-cubic, solid solution of Fe—Al—Cr—C, said solid solution having from about 10 to 80 at. % iron, about 10 to 45 at. % aluminum, about 1 to 70 at. % chromium and about 0.9 to 15 at. % carbon, wherein said material is strengthened by the precipitation of body-centered-cubic particles within the solid solution, said particles having the substantially the same lattice parameters as said solid solution.

2. The material of claim 1, wherein aluminum and chromium are present in a combined amount of at least 30 at. %.

3. The material of claim 1, said material having a yield strength of greater than 320 MPa up to about 650° C.

4. The material of claim 1, said material being polycrystalline.

5. The material of claim 1, which is strengthened by the addition of refractory oxide particles to said solid solution.

6. The material of claims 5, wherein said refractory oxide particles comprise $Y_2O_3$.

7. The material of claim 1, said material having a density of about 5.5 $g/cm^3$ to about 7.5 $g/cm^3$.

8. The material of claim 7, wherein said density is about 6.1 $g/cm^3$.

9. The material of claim 1, said material having a yield strength that stays the same or increases with increasing temperature from room temperature to about 600° C.

10. The material of claim 1, said material having substantially no weight change due to oxidation at temperatures up to about 1150° C.

11. The material of claim 1, said material having a tensile ductility greater than about 95% at temperatures of about 900° C.

12. A composite comprising solid solution phases of Fe—Al—Cr—C, wherein said solid solution phases are each body-centered-cubic and single-phase, said composite having a composition of about 10 to 80 at. % iron, about 10 to 45 at. % aluminum, about 1 to 70 at. % chromium and about 0.9 to 15 at. % carbon, said solid solution phases having substantially the same lattice parameters.

13. A polycrystalline solid solution of Fe—Al—Cr—C comprising a composition of about 10 to 80 at. % iron, about 10 to 45 at. % aluminum, about 1 to 70 at. % chromium and about 0.9 to 15 at. % carbon, wherein aluminum and chromium are present in a combined amount of at least 30 at. %, which is strengthened by the precipitation of body-centered-cubic particles within said polycrystalline solid solution, said particles having substantially the same lattice parameters as said polycrystalline solid solution.

14. The polycrystalline solid solution of claim 13, which is strengthened by the addition of refractory oxide particles to said polycrystalline solid solution.

15. The polycrystalline solid solution of claim 14, wherein said refractory oxide particles comprise $Y_2O_3$.

16. An article comprising a body-centered-cubic, solid solution of Fe—Al—Cr—C, said solid solution comprising from about 10 to 80 at. % iron, about 10 to 45 at. % aluminum, about 1 to 70 at. % chromium and about 0.9 to 15 at. % carbon, wherein said article is strengthened by the precipitation of body-centered-cubic particles within the solid solution, said particles having the substantially the same lattice parameters as said solid solution.

17. The article of claim 16, wherein aluminum and chromium are present in a combined amount of at least 30 at. %.

18. The article of claim 16, said article having a density of about 5.5 $g/cm^3$ to about 7.5 $g/cm^3$.

19. The article of claim 18, wherein said density is about 6.1 $g/cm^3$.

20. The article of claim 16 disposed to have a load applied thereto at temperatures up to about 650° C.

21. The article of claim 20, said article having a yield strength of greater than 320 MPa up to about 650° C.

22. The article of claim 16, said article having a yield strength that stays the same or increases with increasing temperature from room temperature to about 600° C.

23. The article of claim 16, said article having substantially no weight change due to oxidation up to about 1150° C.

24. The article of claim 16, said article having a tensile ductility greater than about 95% at temperatures of about 900° C.

25. A method of making the article of claim 16, said method comprising:

melting a composition comprising about 10 to 80 at. % iron, about 10 to 45 at. % aluminum, about 1 to 70 at. % chromium and about 0.9 to 15 at. % carbon to form a molten Fe—Al—Cr—C alloy under a controlled atmosphere, pouring said molten alloy into a mold under a controlled atmosphere, said mold having a cavity in the shape of said article, cooling said molten alloy to room temperature to form a solid, as-cast article, and removing the solid as-cast article from said mold.

26. The method according to claim 25, wherein said controlled atmosphere consists of an inert gas or a vacuum.

27. A method of strengthening the material of claim 1, wherein said method comprises precipitating body-centered-cubic particles within the solid solution, said particles having substantially the same lattice parameters as said solid solution.

28. The method of strengthening according to claim 27, wherein said method comprises adjusting the amount and the distribution of the body-centered-cubic particles within the solid solution by adjusting the amount of iron, aluminum, chromium and carbon.

29. A turbocharger part comprising a body-centered-cubic, solid solution of Fe—Al—Cr—C, said solid solution comprising from about 10 to 80 at. % iron, about 10 to 45 at. % aluminum, about 1 to 70 at. % chromium and about 0.9 to 15 at. % carbon, wherein said turbocharger is strengthened by the precipitation of body-centered-cubic particles within the solid solution, said particles having the substantially the same lattice parameters as said solid solution.

30. The turbocharger part of claim 29, wherein aluminum and chromium are present in a combined amount of at least 30 at. %.

31. The turbocharger part of claim 29 disposed to have a load applied thereto at temperatures up to about 650° C.

32. The turbocharger part of claim 31, said turbocharger part having a yield strength of greater than 320 MPa up to about 650° C.

33. The turbocharger part of claim 29, said turbocharger part having a yield strength that stays the same or increases with increasing temperature from room temperature to about 600° C.

34. The turbocharger part of claim 29, said turbocharger part having a density of about 5.5 g/cm$^3$ to about 7.5 g/cm$^3$.

35. The turbocharger part of claim 34, wherein said density is about 6 cm$^3$.

36. The turbocharger part of claim 26, which is strengthened by the precipitation of body-centered-cubic particles within the solid solution, said particles having the substantially the same lattice parameters as said solid solution.

37. The turbocharger part of claim 29, which is a turbine rotor.

38. The turbocharger turbine of claim 37, wherein said turbine rotor has blades that are approximately 0.5 mm thick.

39. The turbocharger part of claim 29, which is a compressor.

* * * * *

UNITED STATES PATENT AND TRADEMARK OFFICE

CERTIFICATE OF CORRECTION

PATENT NO. : 6,524,405 B1
DATED : February 25, 2003
INVENTOR(S) : Hui Lin

It is certified that error appears in the above-identified patent and that said Letters Patent is hereby corrected as shown below:

Column 7,
Line 49, "claims 5" should read -- claim 5 --.

Column 10,
Line 8, "6 $cm^3$." should read -- 6.1 $g/cm^3$. --.
Line 9, "claim 26," should read -- claim 29, --.

Signed and Sealed this

Seventeenth Day of June, 2003

JAMES E. ROGAN
*Director of the United States Patent and Trademark Office*